US007115042B2

(12) United States Patent
Gulan et al.

(10) Patent No.: US 7,115,042 B2
(45) Date of Patent: Oct. 3, 2006

(54) SWING TRAINER

(76) Inventors: Thomas Gulan, 3314 County Highway #22A, Bloomingdale, OH (US) 43910; Marcus E. Frankovitch, Rd. 1 Box 38T, Weirton, WV (US) 26062; Michael G. Simon, 218 Kingsview Dr., Weirton, WV (US) 26062; Anthony Perun, 1119 N. Fourth St., Toronto, OH (US) 43964

( * ) Notice: Subject to any disclaimer, the term of this patent is extended or adjusted under 35 U.S.C. 154(b) by 135 days.

(21) Appl. No.: 10/618,528

(22) Filed: Jul. 11, 2003

(65) Prior Publication Data

US 2004/0018885 A1 Jan. 29, 2004

Related U.S. Application Data

(60) Provisional application No. 60/395,555, filed on Jul. 12, 2002, provisional application No. 60/448,346, filed on Feb. 18, 2003.

(51) Int. Cl.
*A63B 69/36* (2006.01)

(52) U.S. Cl. ..... 473/256; 473/219; 473/226

(58) Field of Classification Search ..... 473/219, 473/226, 231, 256, 257, 437, 457, 461, 463
See application file for complete search history.

(56) References Cited

U.S. PATENT DOCUMENTS

| | | | | |
|---|---|---|---|---|
| 2,135,648 | A | 11/1938 | Stumpf | |
| 2,482,015 | A | 9/1949 | McConnell | |
| 2,950,115 | A | 8/1960 | Hurdzan | |
| 3,428,325 | A | 2/1969 | Atkinson | |
| 3,572,706 | A * | 3/1971 | Schroder | 473/234 |
| 4,317,567 | A * | 3/1982 | Blake | 473/233 |
| 4,541,631 | A | 9/1985 | Sasse | |
| 4,602,788 | A | 7/1986 | Wendt | |
| 4,671,508 | A * | 6/1987 | Tetreault | 473/457 |
| 4,809,975 | A * | 3/1989 | Lee | 482/110 |
| 4,969,921 | A * | 11/1990 | Silvera | 473/234 |
| 4,982,963 | A * | 1/1991 | Fazio et al. | 473/256 |
| 5,711,718 | A | 1/1998 | Mueller | |
| 5,769,734 | A | 6/1998 | Qualey, Sr. | |
| 5,807,183 | A | 9/1998 | Benson | |
| 6,083,116 | A | 7/2000 | Loredo | |
| 6,120,385 | A | 9/2000 | Nemeckay | |
| 6,186,904 | B1 | 2/2001 | Bass | |
| 6,231,453 | B1 * | 5/2001 | Jebe | 473/233 |
| 6,475,098 | B1 | 11/2002 | Nemeckay | |
| 2004/0018885 | A1 * | 1/2004 | Gulan et al. | 473/256 |

FOREIGN PATENT DOCUMENTS

| | | |
|---|---|---|
| WO | WO 93/03798 | 1/1993 |

* cited by examiner

*Primary Examiner*—Raleigh W. Chiu
(74) *Attorney, Agent, or Firm*—Kayden, Horstemeyer & Risley, LLP

(57) ABSTRACT

Disclosed are apparatus and method for a golf swing training club. The golf swing training club may include, a shaft, a grip connected to one end of the shaft, a clubhead connected to the other end of the shaft, and a weight coupled to the shaft, where the weight slides along the shaft during the golf swing. The club may include a release mechanism that is connected to the shaft. The release mechanism releases the weight when a centrifugal force is applied on the club. The method for using the golf swing training club may include swinging the club, and causing the weight to slide along the shaft during the golf swing. The method may include releasing the weight from the release mechanism when the centrifugal force is applied to the club.

9 Claims, 5 Drawing Sheets

FIG.2 - BACKSWING

*FIG.3 - DOWNSWING*

SWING TRAINER

CROSS-REFERENCE TO RELATED APPLICATION

This application claims priority to U.S. provisional application entitled, "Big Easy Swing Trainer," having Ser. No. 60/395,555, filed Jul. 12, 2002, and U.S. provisional application entitled "Swing Trainer," having Ser. No. 60/448,346, filed Feb. 18, 2003, which are entirely incorporated herein by reference.

TECHNICAL FIELD

The present invention relates to the field of training devices, particularly devices for training a golf swing.

DESCRIPTION OF THE RELATED ARTS

The game of golf can be a very difficult and frustrating game. Good players spend many hours practicing to become good at the game. Besides spending endless hours at the driving range and hitting countless balls, training clubs have been used to aid golfers in developing a good technique for swinging the golf club.

Qualey, U.S. Pat. No. 5,769,734, discloses a golf swing training device for attachment to a golf club. A bell-shaped weight having an axial bore and a slot that communicates with the bore is slidably mountable to the shaft of a golf club. The weight is attached to and suspended from an elastic, expansible cord. The cord is attached to an eyelet inserted into a recess in a top surface of the golf grip. During the downswing of the club, the weight slides under centrifugal force along the shaft toward the clubhead, which the golfer experiences as progressively increasing resistive force. The degree of resistive force is easily and rapidly adjustable by varying the length of cord between the eyelet and the weight when the club is at rest.

Other training golf clubs with elastic, extensible or expansible cord are disclosed in Atkinson, U.S. Pat. No. 3,428,325 and Hanton, PCT No. W009300378.

However, a heretofore unaddressed need exists in the industry to provide devices for training golfers how to properly swing the club.

SUMMARY OF THE INVENTION

Disclosed are apparatus and method for a golf swing training club. The golf swing training club may comprise, a shaft, a grip connected to one end of the shaft, a clubhead connected to the other end of the shaft, and a weight coupled to the shaft, where the weight slides along the shaft during the golf swing. The club may include a release mechanism that is connected to the shaft. The release mechanism releases the weight when a centrifugal force is applied to the club.

The method for using the golf swing training club may comprise swinging the club, and causing the weight to slide along the shaft during the golf swing. The method may include releasing the weight from the release mechanism when the centrifugal force is applied to the club.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Disclosed herein are a golf club apparatus and an associated method for use of a golf club that trains a person how to properly swing a golf club. In particular, the golf club includes a weight coupled to a shaft, wherein the weight slides along the shaft during a golf swing. Example apparatus are described in reference to the figures. Although the apparatus are described in detail, they are provided for purposes of illustration only and various modifications are feasible. After the example apparatus have been described, examples of operation of the apparatus are provided to explain the manners in which the golf swing training club can train a person how to properly swing a golf club.

Figure 1:
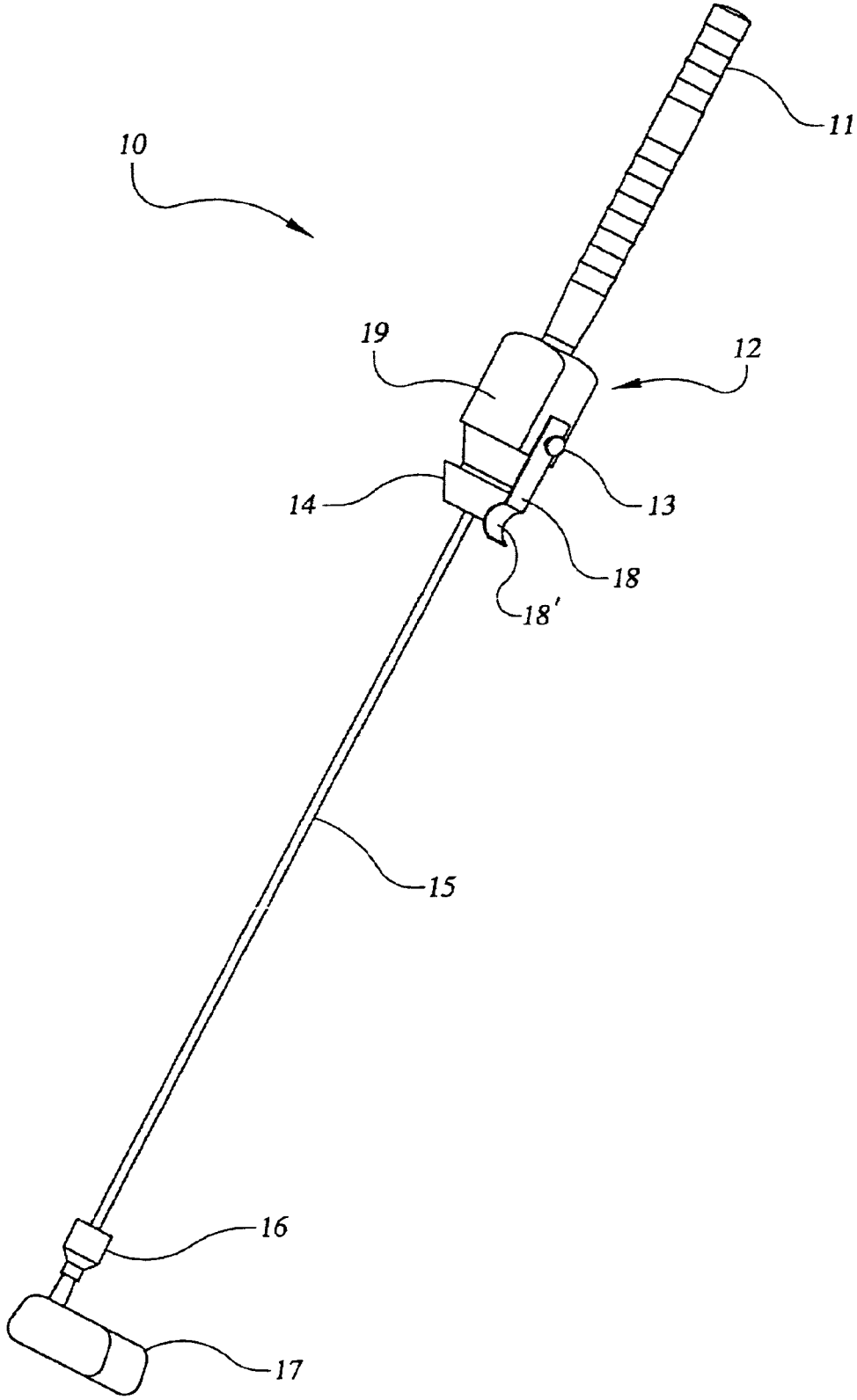
FIG. 1 is a perspective view of an embodiment of a golf swing training club.

FIG. 1 illustrates an example of a golf swing training club 10 that trains a person how to swing a golf club. The club 10 comprises a grip 11, weight 14, shaft 15, and clubhead 17. The clubhead 17 may include a stopper 16, which is located above the clubhead 17 when the stopper 16 is provided. Hereinbelow, when reference is made to the weight 14 hitting the clubhead 17 or stopper 16, it is to be understood that it could be either one. Furthermore, it should be understood that clubhead 17 may itself function as a stopper 16. The shaft 15 may be made of materials that are the same as but that are heavier than standard golf clubs, such as metal, graphite, fiberglass, etc. The grip 11 is coupled to a release mechanism 12. The grip 11 may be an industry standard fabricated grip, such as leather or rubber casing. Further, the grip 11 may be molded such that it provides the golfer the correct grip every time the golfer uses the training club.

The weight 14 slides freely along the shaft 15 during a golf swing. For example, the weight 14 may be located adjacent or near the stopper 16 or the clubhead 17 at the beginning of the swing (i.e., at address). If the club 10 is on a flat plane during the backswing or the golfer is holding the club 10 on a flat plane toward the end of the backswing, the weight 14 may not slide toward the stopper 16 or clubhead 17. However, if the club 10 is on a non-flat plane toward the end of the backswing, the weight 14 slides toward the grip 11. On the downswing, the weight 14 slides toward the stopper 16 or clubhead 17 and hits one or the other. When the weight 14 slides freely along the shaft 15, it operates independently and separately, being acted upon only by either gravity and/or the rotation and motion of the club.

The club 10 may include a release mechanism 12 that is coupled to the shaft 15. The release mechanism 12 may be positioned below the grip 11. The release mechanism 12 may hold the weight 14 at the beginning or during the swing. For example, the weight 14 may be located adjacent or near the stopper 16 or clubhead 17 at the beginning of the swing. Toward the end of the backswing, the weight 14 slides toward the grip 11 and may couple itself to the release mechanism 12. In another alternative, the weight 14 may be coupled to the release mechanism 12 at the beginning of the golf swing.

In both alternatives mentioned above, the release mechanism 12 releases the weight 14 during the downswing when a sufficient centrifugal force is applied to the club 10. The release mechanism 12 may be a spring-loaded device with an adjustment member that increases or decreases the tension of the spring-loaded device applied on the weight 14. The tension on the weight 14 increases or decreases the amount of centrifugal force needed to release the weight 14. The adjustment member may be a screw or dial 13 that is operatively coupled to the base 19 of the release mechanism 12. The adjustment screw 13 may also include a ratchet mechanism to adjust the amount of tension that is applied on the weight 14. The spring-loaded device may also include spring 18, which is operatively coupled to the adjustment screw 13. The spring 18 may include a hole such that the screw 13 may be placed through the hole and screwed into base 19 of the release mechanism 12. The spring 18 may also include an end 18' that angles or curves towards the weight 14, thereby holding and/or releasing the weight 14 when using the club 10. For example, the end 18' may be arcuate, as shown in FIG. 1, the arcuate end 18' making frictional contact with the weight 14 to hold the weight 14 and yet allow its release during the backswing or downswing.

The release mechanism 12 releases the weight 14 when a golfer takes the club back outside or inside the proper target line, or when the golfer uses excessive wrist movement, i.e. "flipping the wrists." The weight 14 is also released when the golfer does not take the club back using the golfer's hands, arms and shoulders in one piece, i.e. all components acting together. In addition, the mechanism 12 releases the weight 14 when the golfer's hands release on the downswing.

As shown in FIG. 1, the weight 14 may comprise of a lower cone-like member, in which the lower cone-like member is connected to an upper cone-like member. The weight 14 may include a hole in the middle of the weight 14. The weight 14 is molded slightly larger than the parallel shaft 15. When a centrifugal force is applied to the club 10, the release mechanism 12 releases the weight 14. The weight 14 is operatively coupled to the shaft 15 such that the weight 14 slides freely along the shaft 15. The weight 14 slides along the shaft 15 and hits the stopper 16, as further described below.

The clubhead 17 is connected to the shaft 15 to prevent the weight 14 from sliding off of the shaft 15. The clubhead 17 may further comprise a stopper 16, which may be comprised of a Teflon® bushing with an aluminum or brass insert. When the weight 14 hits the stopper 16, it provides the golfer a feel of hitting the ball. When the golfer properly swings the club 10, the weight 14 hits the stopper 16 where the clubhead 17 would have impacted the golf ball. When the golfer improperly swings the golf club, the weight 14 either hits the stopper 16 too early or too late relative to where the clubhead 17 would have impacted the golf ball. In this regard, the club 10 provides feedback to the golfer to develop a proper golf swing. The clubhead 17 may include a driving clubhead, wood clubhead or an iron clubhead.

Figure 2:
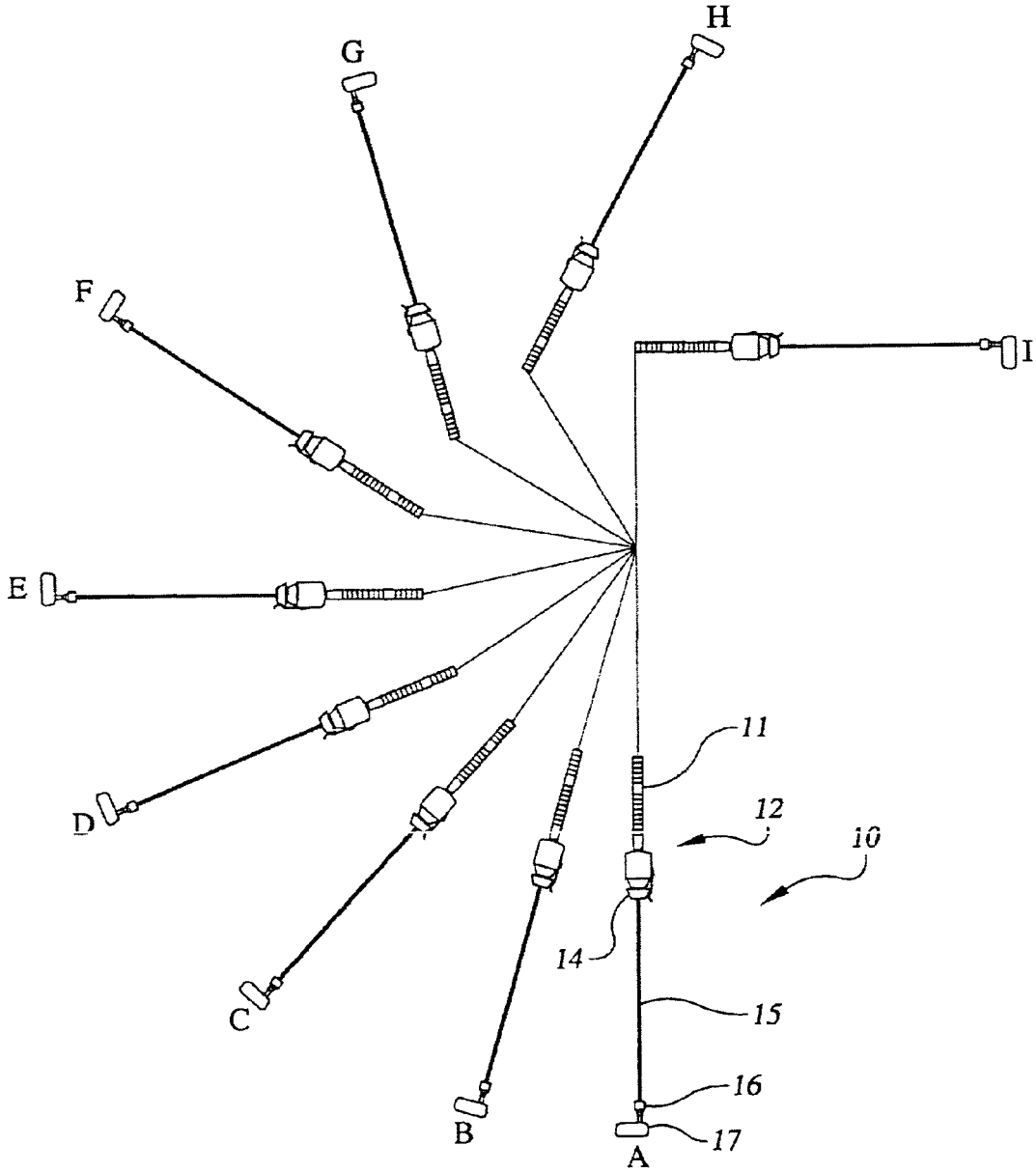
FIG. 2 is a diagrammatic view of a backswing of a golf swing using the golf swing training club shown in FIG. 1.

FIG. 2 illustrates the position of club 10 at various positions during a backswing. FIG. 2 shows that when a golfer takes the golf club 10 back with the golfer's hands, arms and shoulders acting as a unit or in one piece, the weight 14 is not released from the release mechanism 12. When a golfer takes the club back outside or inside the proper target line, or the golfer flips the club with their wrists, the weight 14 is released from the release mechanism 12.

In another alternative, as mentioned above, the weight 14 may be located adjacent or near the stopper 16 or clubhead 17 at the beginning of the swing. If the club 10 is on a flat plane during the backswing or the golfer is holding the club 10 on a flat plane toward the end of the backswing, the weight 14 may not slide toward the stopper 16 or clubhead 17. However, if the club 10 is on a non-flat plane toward the end of the backswing, the weight 14 slides toward the grip 11 and may couple itself to the release mechanism 12. For example, the weight 14 slips under the spring 18 of the release mechanism 12. The weight 14 makes frictional contact with the release mechanism 12 to hold the weight 14.

Figure 3:
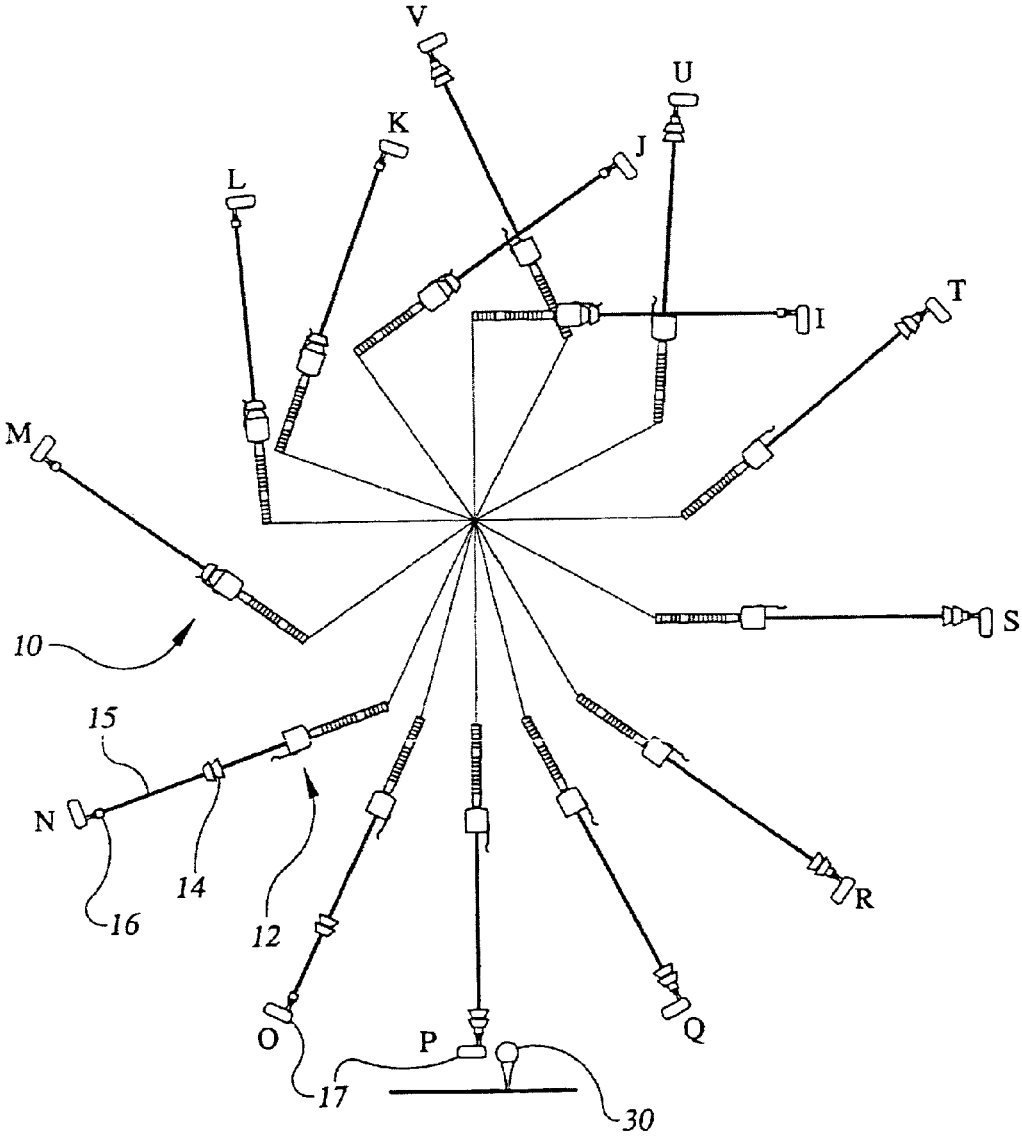
FIG. 3 is a diagrammatic view of a downswing and follow-through of a golf swing using the golf swing training club shown in FIG. 1.

FIG. 3 illustrates the position of club 10 at various positions during the downswing and follow-through. During the downswing, the release mechanism 12 holds the weight 14 through positions I–M. The release mechanism 12 releases the weight 14 when the golfer's hands and wrists begin to release, i.e. uncock, the club 10 as shown at position N. In this regard, the club 10 provides the golfer feedback of when the golfer's hands and wrists release the club 10 during the downswing. If the golfer releases the hands and wrists too early, the weight 14 hits the stopper 16 before the club 10 reaches the point of impact with the golf ball 30. If the hands and wrists are released too late, the weight 14 hits the stopper 16 after the club has passed the point of impact. This provides a valuable feedback to the golfer to train the golfer when to properly release his hands and wrists during the downswing of the club 10. The weight 14 remains adjacent or near the stopper 16 or clubhead 17 as the club 10 travels through positions P–V.

Figure 4:
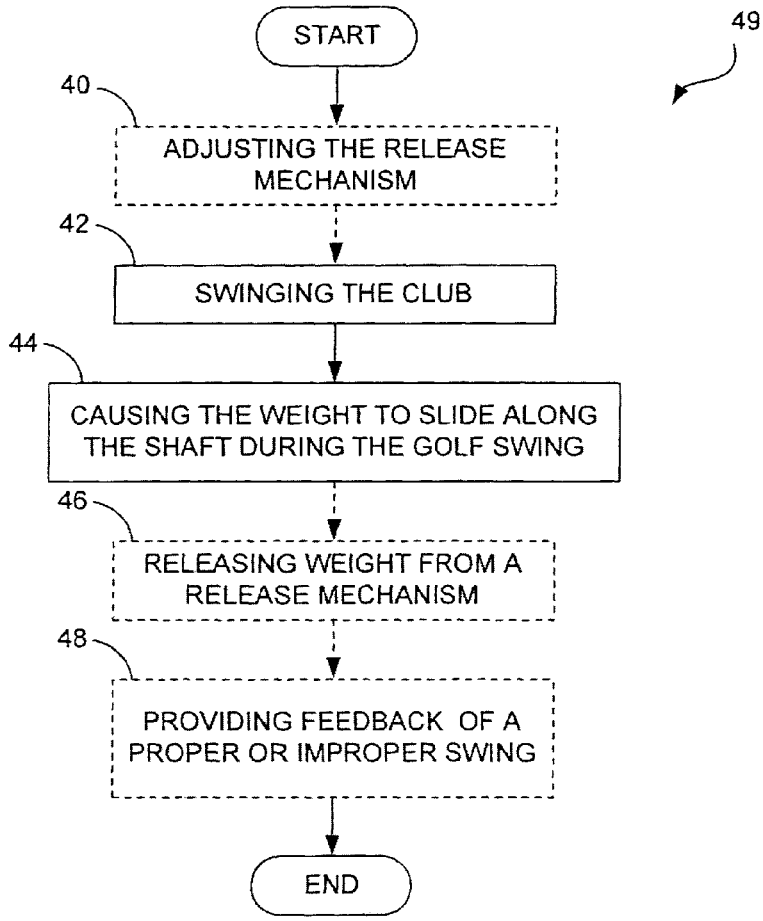
FIG. 4 is a flow diagram that illustrates an embodiment of using the club shown in FIG. 1.

FIG. 4 shows a method 49 for using a golf swing training club. Referring to block 40, the method 49 may include adjusting the release mechanism 12 for increasing or decreasing the amount of centrifugal force needed to release the weight 14. For example the adjustment may include increasing or decreasing the tension of the spring-loaded device on the weight 14.

In block 42, the method 49 includes swinging the golf club. In block 44, causing the weight 14 to slide freely along the shaft 15 during the golf swing, as further described with reference to FIG. 5. When the weight 14 slides freely along the shaft 15, it operates independently and separately, its motion caused only by either gravity and/or the centrifugal force applied to the club 10.

In block 46, the method 49 may include releasing the weight 14 from release mechanism 12 when a centrifugal force is applied to the club. As mentioned above, when the golfer does not take the club back using the golfer's hands, arms and shoulders in one piece, the weight 14 is released from the release mechanism 12. The weight 14 is also released when the golfer takes the club back outside or inside the proper target line, or flips the club with the golfer's hands and wrists. In addition, the weight 14 is released when the golfer's hands and wrists release on the downswing.

As mentioned above, the release mechanism 12 may hold the weight 14 at the beginning or during the swing. For example, the weight 14 may be located adjacent or near the stopper 16 or the clubhead 17 at the beginning of the swing. Toward the end of the backswing, the weight 14 slides toward the grip 11 and may couple itself to or at least abuts the release mechanism 12. In another alternative, the weight 14 may be coupled to the release mechanism 12 at the beginning of the golf swing. In both alternatives mentioned above, the release mechanism 12 releases the weight 14 during the downswing when a centrifugal force is applied to the club 10.

In block 48, the method 49 may include providing an impact between the weight 14 and clubhead 17 generating a feedback to the golfer of a proper or improper swing.

Figure 5:
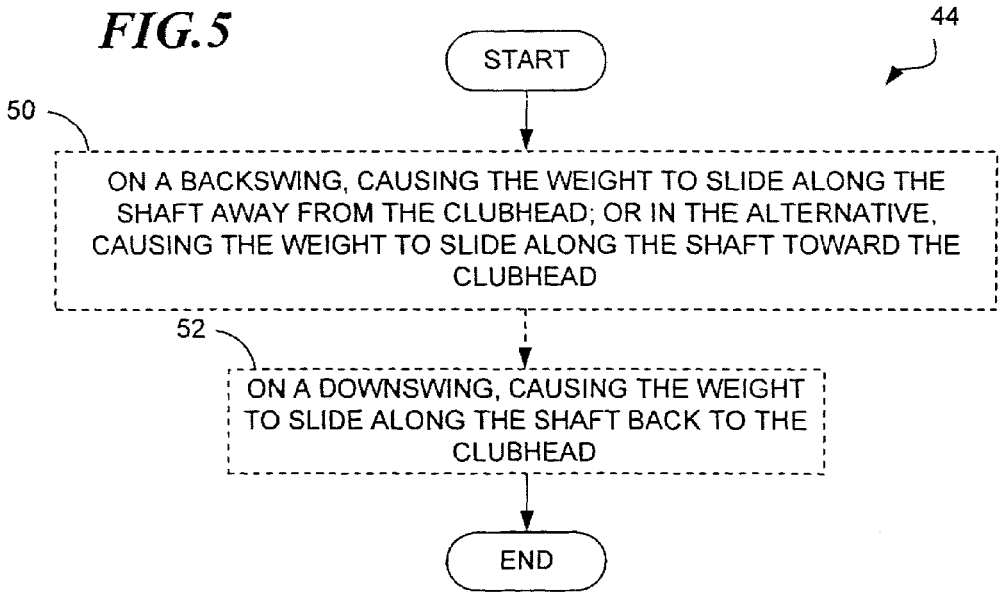
FIG. 5 shows examples of the step to cause the weight to slide along the shaft during a golf swing as shown in block 44 of FIG. 4.

FIG. 5 shows examples of the step to cause the weight to slide along the shaft during a golf swing, as shown in block 44 of FIG. 4. In block 50, as mentioned above, the weight 14 may be located adjacent or near the stopper 16 or the clubhead 17 at the beginning of the swing. At the end of the backswing, the weight 14 slides toward the grip 11. In another alternative, the weight 14 may be coupled to the release mechanism 12 at the beginning of the golf swing. In both alternatives mentioned above, the release mechanism 12 releases the weight 14 during the downswing when a centrifugal force is applied to the club 10, as indicated in block 52.

Figure 6:
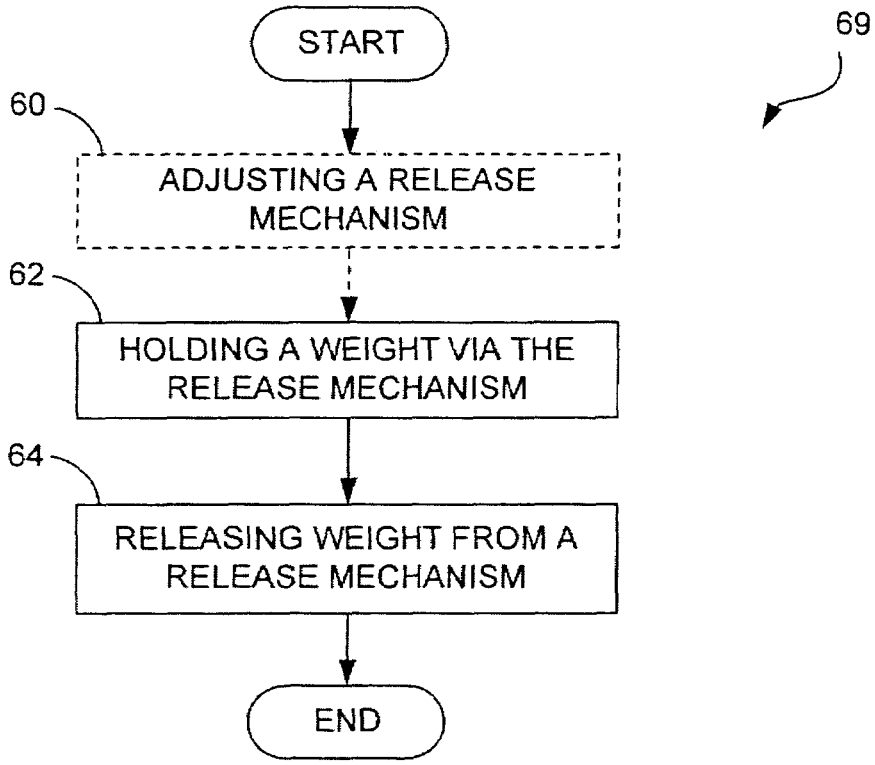
FIG. 6 shows a method for operating a golf swing training club.

FIG. 6 shows a method 69 for operating a golf swing training club. Referring to block 60, the method 69 may include adjusting a release mechanism 12 for increasing or decreasing the amount of centrifugal force needed to release the weight 14. For example, the adjustment may include increasing or decreasing the tension of the spring-loaded device on the weight 14.

In block 62, the method 69 includes holding a weight 14 via the release mechanism 12. As mentioned above, the release mechanism 12 may hold the weight 14 at the beginning or during the swing. For example, the weight 14 may be located adjacent or near the stopper 16 or the clubhead 17 at the beginning of the swing. Toward the end of the backswing, the weight 14 slides toward the grip 11 and couples itself to the release mechanism 12. In another alternative, the weight 14 may be coupled to the release mechanism 12 at the beginning of the golf swing. In both alternatives mentioned above, the release mechanism 12 releases the weight 14 during the downswing when a centrifugal force is applied to the club 10, as indicated in block 64.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

The invention claimed is:

1. A golf swing training club comprising:

a shaft;

a clubhead;

a weight coupled to the shaft, wherein the weight slides along the shaft during a golf swing; and a release mechanism being connected to the shaft and being capable of providing tension between the weight and the shaft, the release mechanism including an adjustment member that is coupled to the weight, the release mechanism being capable of releasing the weight when a centrifugal force is applied to the club, wherein the adjustment member adjusts the tension imposed between the weight and the shaft to adjust the amount of centrifugal force needed to release the weight during the swing, wherein the weight slides down the shaft and hits the clubhead to provide feedback of a proper or improper swing.

2. The club as defined in claim 1, further comprising a grip.

3. The club as defined in claim 2, wherein the grip is molded to provide a correct hand grip.

4. The club as defined in claim 1, wherein the release mechanism is a spring-loaded device.

5. The club as defined in claim 1, wherein the clubhead includes a stopper.

6. The club as defined in claim 1, wherein the shaft is a weighted shaft.

7. The club as defined in claim 1, wherein the weight slides away from the clubhead along the shaft on a backswing and the weight slides back to the clubhead on a downswing.

8. A method for using a golf swing training club with a shaft, weight, and clubhead comprising the steps of:

swinging the club;

causing a weight to slide along the shaft during the golf swing;

adjusting tension of the weight against the shaft to adjust the amount of centrifugal force needed to release the weight during the swing;

releasing the weight during the swing when the centrifugal force is applied to the club; and causing the weight to slide down the shaft and hitting the clubhead to provide feedback of a proper or improper swing.

9. The method as defined in claim 8, including the step of causing the weight to slide along the shaft away from a clubhead on a backswing, and causing the weight to slide along the shaft back to the clubhead on a downswing.

* * * * *